US009981778B2

(12) United States Patent
Plattner

(10) Patent No.: US 9,981,778 B2
(45) Date of Patent: May 29, 2018

(54) CONTAINER FOR TRANSPORTING GOODS AND DEVICE FOR DIVIDING SUCH A CONTAINER

(71) Applicant: GEORG UTZ HOLDING AG, Bremgarten (CH)

(72) Inventor: Patrik Plattner, Hermetschwil-Staffeln (CH)

(73) Assignee: GEORG UTZ HOLDING AG, Bremgarten (CH)

( * ) Notice: Subject to any disclaimer, the term of this patent is extended or adjusted under 35 U.S.C. 154(b) by 0 days. days.

(21) Appl. No.: 15/112,073

(22) PCT Filed: Jan. 8, 2015

(86) PCT No.: PCT/IB2015/050139

§ 371 (c)(1),
(2) Date: Jul. 15, 2016

(87) PCT Pub. No.: WO2015/107438

PCT Pub. Date: Jul. 23, 2015

(65) Prior Publication Data

US 2016/0325885 A1 Nov. 10, 2016

(30) Foreign Application Priority Data

Jan. 17, 2014 (CH) ..... 0062/14

(51) Int. Cl.
*B65D 25/06* (2006.01)
*B65D 5/48* (2006.01)
*B65F 1/00* (2006.01)

(52) U.S. Cl.
CPC ..... *B65D 25/06* (2013.01); *B65D 5/48* (2013.01); *B65F 1/004* (2013.01)

(58) Field of Classification Search
CPC ..... B65D 25/06; B65D 25/04; B65D 1/24; B65D 1/243; B65D 1/36; B65D 5/48024;
(Continued)

(56) References Cited

U.S. PATENT DOCUMENTS 4,499,997 A * 2/1985 Swingley, Jr. ..... B65D 21/0219 206/427
4,529,092 A * 7/1985 Swingley, Jr. ..... B65D 25/06 206/425

(Continued)

FOREIGN PATENT DOCUMENTS

CH 705 452 3/2013
DE 89 13 760 1/1990

(Continued)

OTHER PUBLICATIONS

International Search Report issued by the European Patent Office in International Application PCT/1B2015/050139.

*Primary Examiner* — Anthony Stashick
*Assistant Examiner* — Robert Poon
(74) *Attorney, Agent, or Firm* — Henry M. Feieresien LLC

(57) ABSTRACT

A container includes a bottom, lateral walls, and a device for dividing the interior of the container. The device has a groove at each opposing lateral wall and a partition. Each groove extends from an upper edge of the lateral wall over a part of the height of the lateral wall. Each groove and the end faces of the partition have a cross-sectional shape transverse to their longitudinal extension, so that the end face of the partition and each groove can be united by a form-fit. Each groove can have an undercut.

4 Claims, 5 Drawing Sheets

(58) Field of Classification Search
CPC ..... B65D 5/4803; B65D 5/48038; B65D 5/48046; B65D 5/48; B65D 7/065; B65F 1/004; B65F 1/0046
USPC ..... 220/507, 529, 532, 533, 552; 206/425
See application file for complete search history.

(56) References Cited

U.S. PATENT DOCUMENTS

| | | | | | |
|---|---|---|---|---|---|
| 4,577,773 | A * | 3/1986 | Bitel | B25H 3/02 | 206/561 |
| 4,867,328 | A * | 9/1989 | McCarthy | B65F 1/0046 | 220/495.08 |
| 5,299,688 | A * | 4/1994 | McKay | A45C 11/18 | 206/425 |
| 6,039,202 | A * | 3/2000 | Olstad | A45C 11/20 | 220/23.88 |
| 6,527,122 | B1 * | 3/2003 | Taylor | B65D 21/0212 | 206/509 |
| 8,950,342 | B2 | 2/2015 | Plattner | | |
| 2004/0238543 | A1 * | 12/2004 | Askew | B65D 25/06 | 220/529 |
| 2006/0169658 | A1 * | 8/2006 | Lim | A47B 55/02 | 211/133.1 |
| 2008/0128428 | A1 | 6/2008 | Beckerman | | |
| 2014/0124406 | A1 * | 5/2014 | Ishikawa | B65D 21/0213 | 206/557 |

FOREIGN PATENT DOCUMENTS

| | | |
|---|---|---|
| EP | 1 845 024 | 10/2007 |
| EP | 1 982 926 | 10/2008 |
| JP | 2004-268978 | 9/2004 |
| WO | WO 84/03268 | 8/1984 |
| WO | WO 2013/011672 | 1/2013 |

* cited by examiner

CONTAINER FOR TRANSPORTING GOODS AND DEVICE FOR DIVIDING SUCH A CONTAINER

CROSS-REFERENCES TO RELATED APPLICATIONS

This application is the U.S. National Stage of International Application No. PCT/IB2015/050139, filed Jan. 8, 2015, which designated the United States and has been published as International Publication No. WO 2015/107438 and which claims the priority of Swiss Patent Application, Serial No. 00062/14, filed Jan. 17, 2014, pursuant to 35 U.S.C. 119(a)-(d).

TECHNICAL FIELD

The invention relates to a container for the storage and transport of goods and in particular to a device for dividing the interior of such a container.

STATE OF THE ART

Containers with devices for dividing the interior are known. They are used to equip a container as required so that goods stored or transported in the container can be, for example, separated from each other, supported or protected from each other.

In particular, subdivisions are known that can be taken out so that the container can be used as required with or without partition. Such containers include on their side walls, for example, a vertical groove which extends over the entire height of the side wall and in which partitions can be pushed in from the opening of the container. For this purpose, elements are fastened to the end faces of the partitions with a profile conforming to the groove. The groove extends over the entire height of the side wall in order to ensure sufficient fixation of a partition. When cleaning such containers, dirt or other residues remain at the lower end of such a groove. This is in particular a problem with containers for food.

EP1845024 discloses, for example, a section part device for a container comprised of divider walls and device elements, wherein the contact elements are used to fasten the divider walls to the side walls of the container. The contact elements are supported flexibly on the end faces of the divider wails. The divider walls are held by means of spring tongues on the contact elements in the container.

EP1982926 discloses a storage and transport container, which can be subdivided by partitions and partition holders. The partitions are initially equipped for this purpose with the partition holders. The holders have on their end faces snap-in cams, which are snapped into corresponding perforations in the side walls of the container.

CH705452 discloses an insert for a container comprised of partitions, which are plugged into each other crosswise via slots. The partitions have parallel webs for guiding the edges of the slots while being plugged in. In addition, protruding elements are provided on the lower edges of the partitions, which fit into respective recesses in the bottom plate of the container, so that the partitions are fixed slip-proof on the bottom plate.

DESCRIPTION OF THE INVENTION

It is the object of the present invention to create a container for goods which has a device for partitioning, which ensures a stable division and can also be manufactured simply and economically. In addition, it is the object of the present invention to create a partition for installation in a container for the purpose of partitioning its interior.

A container includes a bottom, side walls surrounding the bottom, and a device for dividing the interior of the container formed by the side walls and the bottom. In accordance with the invention, the device for the partitioning has a groove on each of at least two opposing side walls of the container and at least one partition, wherein each groove extends from the upper edge of the side wall over a part of the height of the side wall of the container. In particular, each groove and the lateral end faces of the partition have each a shape, by which the end faces of the partition and the grooves are united by a form fit.

In a first embodiment of the invention, the groove has at least a one-sided undercut, i.e. the undercut is only on one side of the center of the groove and the contour is asymmetrical as such. The partition has on the end face a one-sided protruding contour which conforms to the groove and the undercut for insertion into the undercut of the groove by a form fit.

In a second embodiment of the invention, the groove has a two-sided undercut, i.e., the undercut is on both sides of the center of the groove. The partition has on each lateral end face a two-sided protruding contour which conforms to the shape of the groove for insertion into the groove by a form fit.

In a particular embodiment of the invention, the one-sided undercut of the groove and the conforming protruding contour of each end face of the partition are configured L-shaped in cross section with respect to their longitudinal extension.

In a particular embodiment, the two-sided undercut of the groove as well as the contour of each end face of the partition are configured T-shaped in cross section.

In a particular embodiment of the invention, the two-sided undercut of the groove as well as the contour of each end face of the partition are configured dovetailed in cross section.

In all these embodiments, the end face of the partition has a protruding contour to conform to the shape of the groove, wherein this protruding contour extends over a part of the height of the partition, which part corresponds at a maximum to the height extension of the groove in the side wall.

The device for dividing the interior of a container ensures a sufficiently strong connection of the partition with the container wall and support of the partition by the undercut of the groove and the respectively shaped end face of the partition formed to realize a form fit, even though the groove exists over a reduced length over a part of the height of the side wall of the container.

A container with the device according to the invention for dividing can be manufactured simply and therefore economically, since it requires only two different parts, the container with the groove and the partition with the formed end face, both of which can be manufactured by an injection molding procedure. There is no need for small additional individual parts as transition pieces for attaching the partition to the container wall as described in the art. By only uniting two parts, insertion and withdrawal again can be realized in a fast and efficient manner. In addition, no tools are necessary for the insertion and release of the partitions.

A container with the device according to the invention can especially be simply and reliably cleaned, since the groove extends only over a part of the height of the container wall and ends on a partial height above the container bottom. Dirt and water can be removed without residues from the groove.

The container according to the invention can be used both with and without partitions, wherein, when used without partitions, no elements protrude to which goods could cling or a packing person could get injured.

The absence of protruding elements also optimizes the interior volume when used without partitions.

In an useful embodiment of the invention, a square container has a groove with a two-sided, symmetrical undercut on each of opposing side walls and a partition having two end faces provided with a two-sided protruding, symmetrical shape, which can be inserted formfittingly into the groove. The two-sided and symmetrically configured groove and end face of the partition permits a simplified manufacture and a simple insertion of the partition, since the partition can be inserted regardless of its orientation.

In a further particular embodiment of the invention, the groove has a first upper area adjacent to the upper edge of the side wall of the container and a second lower area, which lies deeper in comparison to the first area and extends from the first area in the direction of the container bottom. The first upper area of the groove is configured with a rectangular cross section and without undercut, and the second lower area is configured with an undercut. Preferably, the transition from the first to the second area is configured along the length of the groove with a slanted wall, so that the transition runs gradually. This configuration simplifies insertion of the partition end faces into the groove, without requiring the partition to be precisely fit into the groove with undercut. Instead, the partition can first be inserted into the first area of the groove and then pushed downward and thereby guided by the slanted walls into the second area of the groove with undercut.

In a further embodiment, at the bottom, the container has in the surface, pointing to the interior, an indentation in an area directly below the groove. In addition, the partition has at its lower edge a projection, which is formed in conformity with the indentation and spaced from the end face of the partition in accordance with the position of the indentation in the container bottom. As a result of this positioning, the projection can be inserted formfittingly into the indentation when the partition is inserted into the container.

In a further embodiment, each groove has an indentation or an opening on its base area, with each end face of the partition having a rounded projection at a height to enter the said opening or indentation, when the partition is inserted into the groove and the partition impacts the container bottom. This enables the partition to snap into the side wall of the container and prevents a partition from falling out of the container, when the container should be turned over. However, the rounded shape of the projection permits a removal of the partition from the groove by applying light manual force.

In a further embodiment, the partitions have each one or more slots, which extend from their lower edge or upper edge over a part of their height. This permits a crossed nesting into one another of partitions that are perpendicular to each other and dividing of the container into smaller sub-regions.

Also disclosed are embodiments of the invention based on combinations of the features described here.

The container and the partition in accordance with the invention are preferably made of plastic.

BRIEF DESCRIPTION OF THE FIGURES

Further advantages of the invention become apparent from the following description, in which the invention is explained in more detail with reference to exemplary embodiments schematically illustrated in the drawings. It is shown in.

The same reference numbers have been used for same elements and first-time explanations relate to all figures, unless expressly mentioned otherwise.

EXEMPLARY EMBODIMENTS OF THE INVENTION

Figure 1:
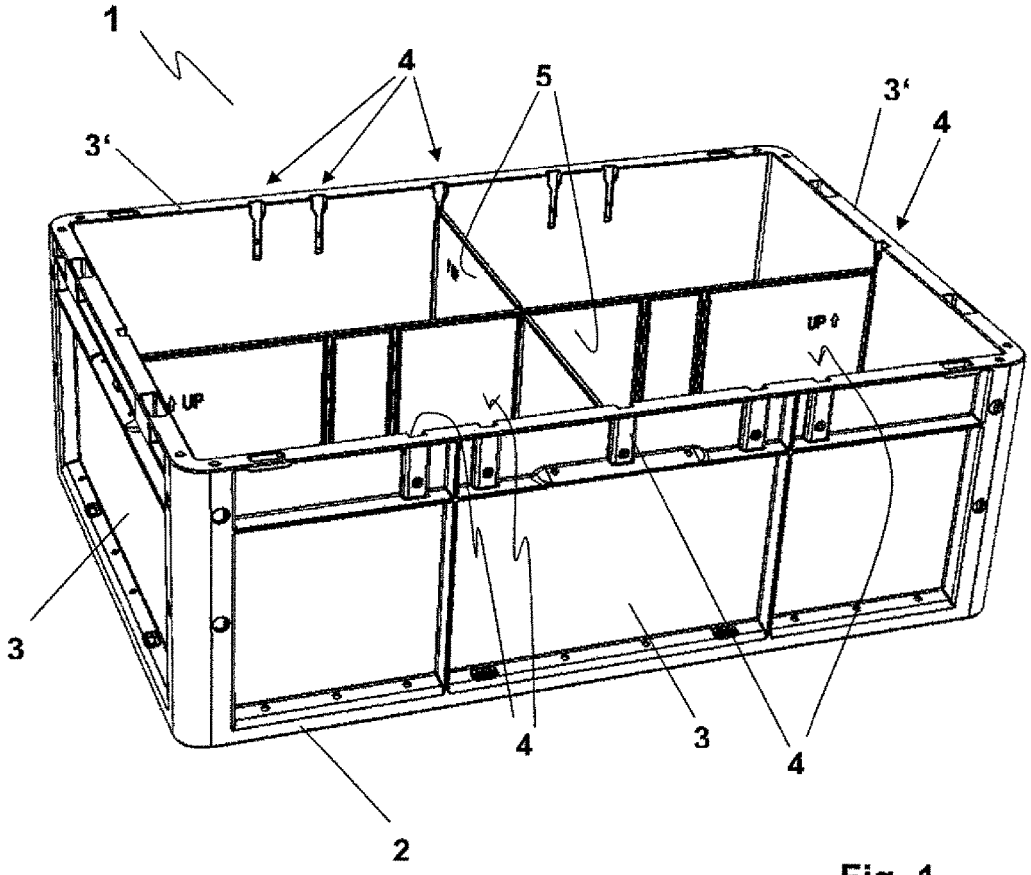
FIG. 1 a perspective view of a container according to the invention with provided grooves and two partitions arranged therein.
Figure 2:
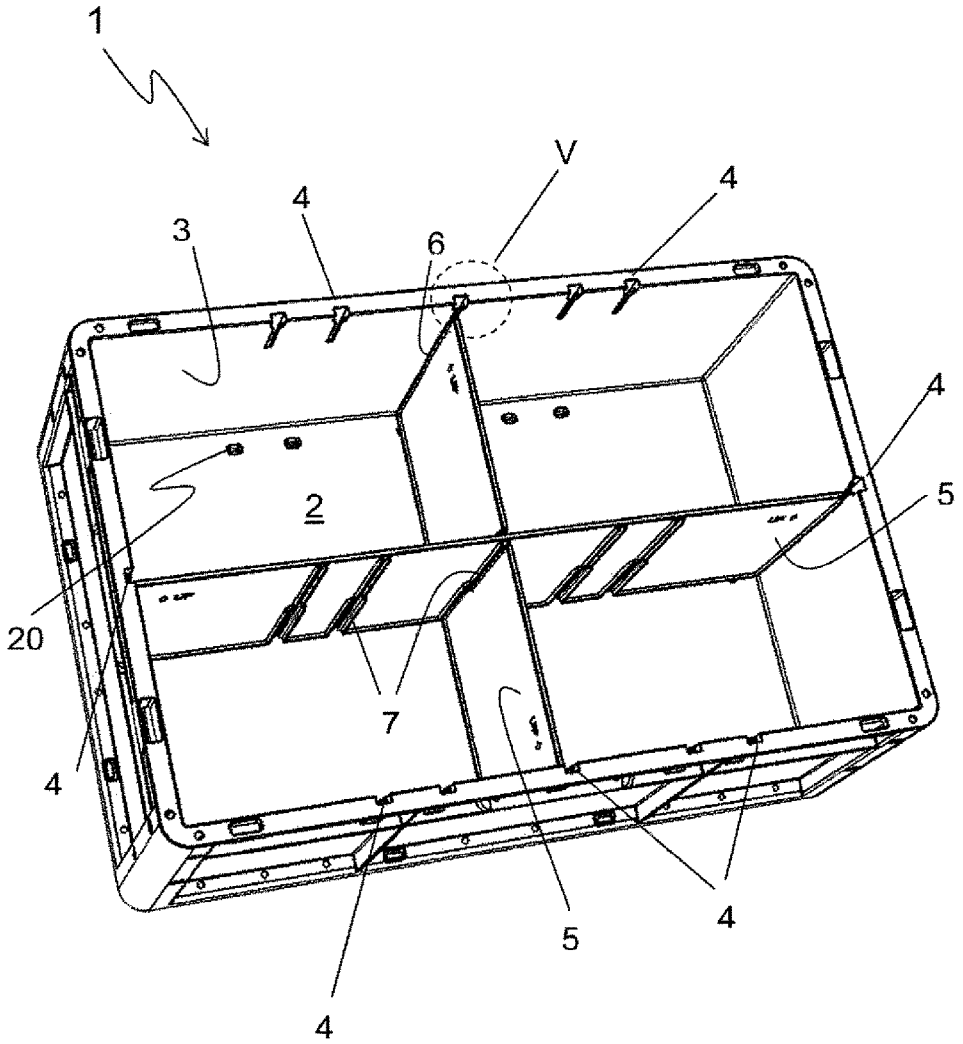
FIG. 2 a perspective view from above of the container according to the invention of FIG. 1 with indentations in the bottom of the container.

FIGS. 1 and 2 show a container 1 with a bottom 2 and surrounding side walls 3. In accordance with the invention, the side walls 3 have on their upper edges 3' grooves 4, which are arranged in pairs in opposing side walls 3, respectively. The grooves 4 extend from the upper edge 3' in the direction of bottom 2, however, only over a part of the height of the side wall 3, for example, over one fourth of the height. Two partitions 5 perpendicular to each other are fastened to the side walls 3 in the exemplary embodiment shown here, by inserting their lateral end faces 6 into the grooves 4. The partitions 5 have each slots 7, which extend over a part of the height of the partitions and by which the two partitions 5 perpendicular to each other are plugged into one another. The partitions 5 can be positioned randomly and in any number according to the grooves and slots in the container. Indentations 20 are arranged at the bottom 2 of the container and respectively positioned at a distance from the lower edge of a side wall 3, but directly underneath a groove 4.

Figure 3:
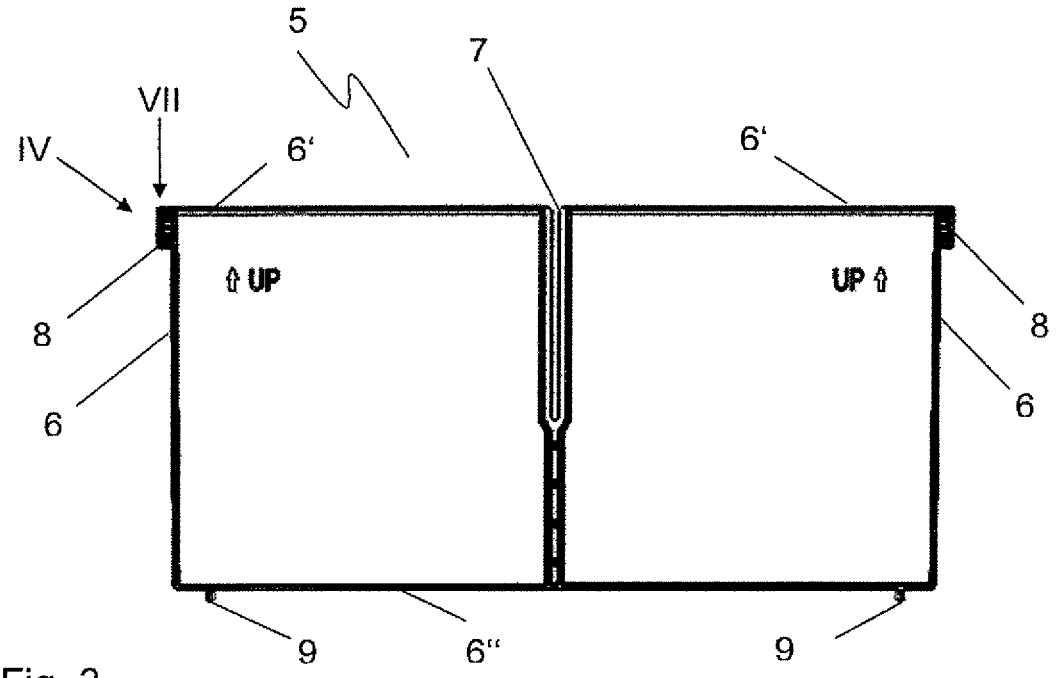
FIG. 3 a side view of a partition of the device for dividing the interior of a container.

FIG. 3 shows an example of a partition 5 according to the invention, with each of its two lateral end faces 6 being provided with a protruding contour 8, which extends from its upper edge 6' in the direction of the lower edge 6", however only over a part of the height of the partition. The height of the protruding contour 8 is at a maximum the height of a groove 4 on the side wall 3 of the container 1.

Arranged at the lower edge 6" of the partition 5 in proximity of each of the two end faces is a protruding projection 9, which extends away from the lower edge 6".

Figure 4:
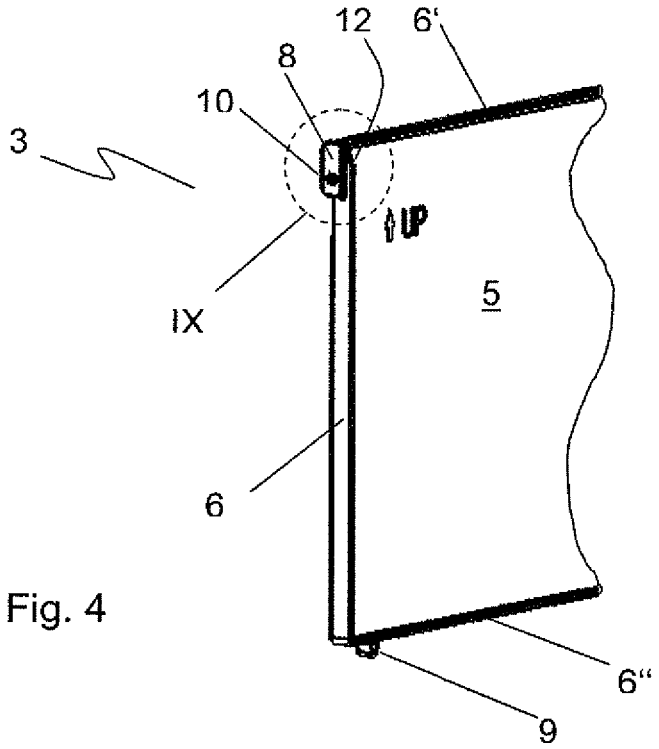
FIG. 4 a perspective view of a part of a partition from FIG. 3, in particular the end face of the partition and the projection at the partition lower edge.

FIG. 4 shows the end face 6 of a partition 5 in more detail, in particular the protruding contour 8 on the end face 6 and the projection 9 at the lower edge 6". The protruding contour 8 has in particular a rounded projection 10, which fits in an opening in the groove 4 of a side wall 3, as is shown in FIG.

8. In addition, the end face 6 is configured slightly wider in comparison to the thickness of the side wall by the presence of an element 12.

Figure 7:
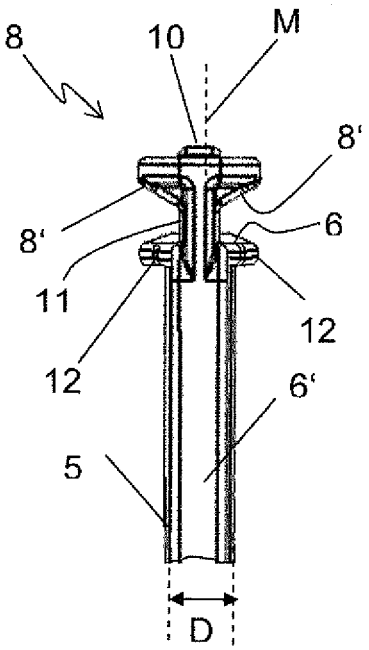
FIG. 7 a perspective view from above of the end face of the partition of FIG. 3.
Figure 9:
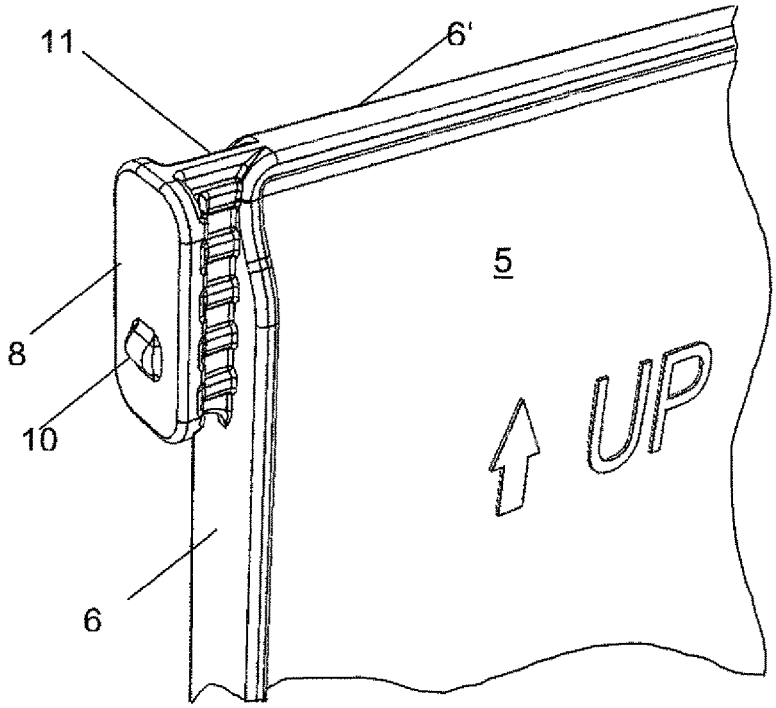
FIG. 9 a more detailed perspective view of the end face of a partition of FIG. 4.

FIGS. 7 and 9 show the protruding contour 8 on the partition 5. It is symmetrically configured in this exemplary embodiment, by having a protruding, dovetailed contour 8' on each of both sides of a center line M parallel to the upper edge 5'. In addition, the contour 8 has a straight element 11 in prolongation of the partition 5' to connect the end face 6 and the dovetailed contour 8'. For purposes of reinforcement of the element 11, the latter is designed ribbed for example. In addition, the end face 6 has elements 12, so as to be wider in comparison to the thickness d of the partition 5. It is also conceivable to configure the end face 6 of the partition without the elements 12.

Figure 5:
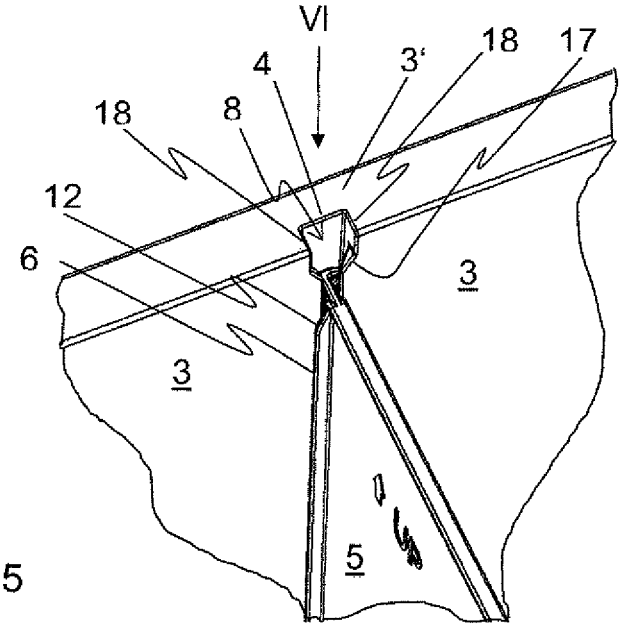
FIG. 5 a perspective view from above the partition which is inserted into a groove of FIG. 2.

FIG. 5 shows a groove 4 in a side wall 3 of the container of FIG. 2 as well as the inserted partition 5 with protruding contour 8 on the end face 6. The partition is inserted formfittingly into the groove 4, with the end face resting with lateral elements 12 upon the side wall 3. The lateral elements 12 extend over the entire length of the end face 6 of the partition 5. The first upper area and the second lower area of the groove are readily apparent in the Figure. The upper area adjacent to the upper edge 3' has a rectangular shape with straight side walls 18, extending perpendicular to the side wall 3. Walls 17 extend slantingly downward from the side walls 18 and form the transition from the upper area to the lower area of the groove 4. The lower area of the groove has a narrow opening, in which the element 11 of the contour 8 fits in accordance with FIG. 6.

Figure 6:
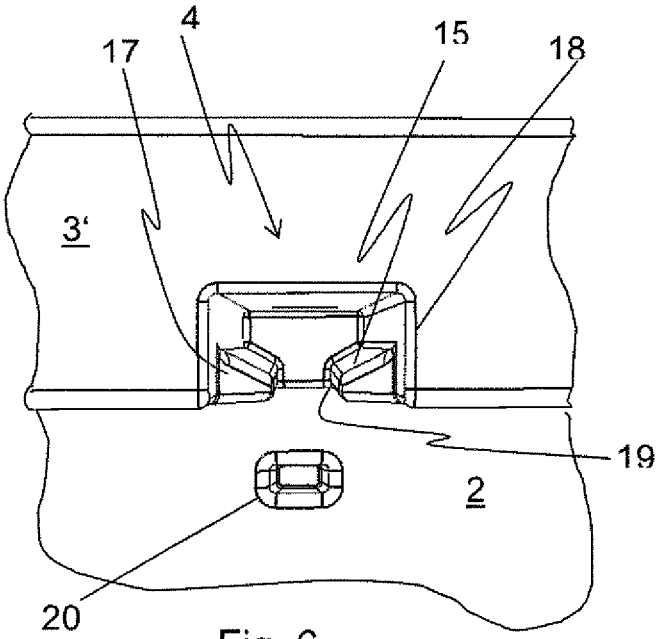
FIG. 6 a perspective view from above of the groove of FIG. 5 in the side wall of a container as well as the indentation in its bottom.

FIG. 6 shows the groove 4 without inserted partition, in order to better recognize the shape of the groove. In addition, the indentation 20 arranged in the bottom 2 is shown in the FIG. 6 and is located directly underneath the groove 4 in the bottom at a distance from the lower edge of the side wall. When a partition 5 is inserted into the groove 4 and pushed downward to the bottom 2 of the container, the projection 9 can be snapped into the indentation 20 on the lower edge 6" of the partition 5. This additionally strengthens the position and shape of the partition in the container and prevents a bending of the partition to the side.

Figure 8:
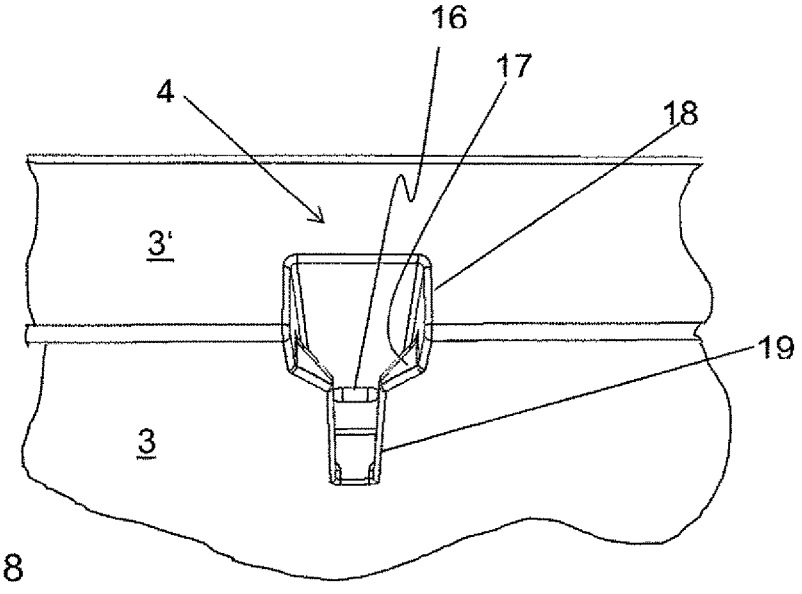
FIG. 8 a view of the groove, in particular of the upper area of the groove with rectangular cross section and the slanted edges to the lower area of the groove.

FIG. 6 shows the upper area of the groove in proximity of the upper edge 3', which is configured rectangular with side walls 18 extending perpendicular to the side wall 3. A side wall 17 extends slantingly downward from the rectangular shape of the groove to a narrower area 19 of the groove, whose width corresponds to the width of the element 11 in FIG. 7. This is also illustrated in FIGS. 5 and 8, in accordance with which the groove 4 has a rectangular shape 18 in the upper area near the upper edge 3'. The rectangular shape 18 is provided to facilitate insertion of the contour 8 of the partition into the groove 4, so that the simultaneous form-fitting union of the contours 8 can be more easily realized on both end faces 6 of a partition into the grooves 4 of opposite side walls 3. In addition, FIG. 6 shows the lower area of the groove 4 with side walls 15, which extend at an angle to the side wall 3 and correspond to the dovetail shape of the contour 8 on the partition 5. The side walls 15 in the lower area of the groove are thus located not directly on the upper edge 3' of the side wall but rather only a short distance underneath the upper edge 3'

In the shown exemplary embodiment, the side walls 15 form the two-sided undercut of the groove which is present in this case only in the lower area.

In further possible configurations, the side walls 15 can also extend over the entire length of the groove, i.e., up to the upper edge 3' of the side wall 3. In such a case, the groove does not have an upper rectangular area, as shown in the Figures.

In a further possible embodiment, the side wall 15 can also be provided only on one side, wherein the contour on the end face of the partition has to be formed correspondingly.

In a further possible embodiment, the side wall 15 can also extend parallel to the side wall 3, instead of at an angle. In such a case, the undercut would be configured T-shaped. Also, in these cases, the undercut can be formed over the lower area or over the entire length of the groove.

The invention claimed is:

1. A container, comprising:

a bottom;

four side walls surrounding the bottom and jointly forming an interior with the bottom, wherein two side walls are arranged opposing one another and further two side walls are arranged opposing one another, at least two opposing ones of the sidewalls having each a groove extending from an upper edge of the side wall along an upper part of a height of the sidewall; and a device configured to divide the interior, said device including at least one partition having an end face, with the groove and the end face having each a cross-sectional shape transverse to their longitudinal extensions to unite the end face of the partition with the groove by a form fit, each said groove having a two-sided undercut, said end face of the partition having a two-sided dovetail contour conforming to a shape of the groove and insertable into the groove in a form-fitting manner, said dovetail contour having a straight element to connect the end face and the dovetail contour in prolongation of the partition, said straight element having reinforcement ribs, each said groove having a first area adjacent to the upper edge of the side wall and a second area which extends from the first area in a direction of the bottom, said first area of the groove having a rectangular cross section and said second area being configured with an undercut, said end face of the partition having an element such that the end face has a width which is greater than a thickness of the partition, said element resting upon the side wall after the partition has been inserted into the groove of the side wall.

2. The container of claim 1, wherein the bottom has an indentation in a surface pointing toward the interior in an area directly underneath the groove, said partition having a lower edge provided with a projection for insertion into the indentation in a form-fitting manner.

3. The container of claim 1, wherein each groove has a base area formed with an indentation or opening, said end face of the partition having a rounded projection for insertion into the indentation or opening in a form-fitting manner.

4. The container of claim 1, wherein the container is made of plastic.

* * * * *